United States Patent [19]

Lauritsen

[11] 3,938,560

[45] Feb. 17, 1976

[54] APPARATUS FOR THE MECHANICAL OPERATION OF THREAD OR YARN GUIDES

[76] Inventor: William Eger Nyboe Lauritsen, Strandvagen 22, 443 00 Lerum, Sweden

[22] Filed: Feb. 26, 1974

[21] Appl. No.: 446,042

[30] Foreign Application Priority Data

Mar. 5, 1973 Sweden ..... 7302989

[52] U.S. Cl. ..... 139/59

[51] Int. Cl.[2] ..... D03C 3/00

[58] Field of Search ..... 139/59–65, 139/55, 71

[56] References Cited

UNITED STATES PATENTS

| | | | |
|---|---|---|---|
| 592,005 | 10/1897 | Hardwick | 139/60 |
| 1,944,369 | 1/1934 | Randall | 139/59 |
| 3,451,129 | 6/1969 | Alonso et al | 139/59 X |
| 3,810,492 | 5/1974 | Lauritsen | 139/59 |
| 3,828,826 | 8/1974 | Hurzeler | 139/59 |
| 3,835,894 | 9/1974 | Speich | 139/59 |

OTHER PUBLICATIONS 1,055,463 4–16–1959 German Application (Grosse).

*Primary Examiner*—James Kee Chi
*Attorney, Agent, or Firm*—Browne, Beveridge, DeGrandi & Kline

[57] ABSTRACT

An apparatus for the mechanical operation of thread or yarn guides in textile making machines. The apparatus includes selectors arranged longitudinally of the guides, and by means of pulses supplied from outside, the selectors are adapted, by form-closed engagement with the guides, to prevent and, in the absence of an engagement, to permit the guides being carried along by continuously reciprocating operating means. The apparatus also includes spring means which tend to move the guides out of such an engagement with the selectors as will prevent the guides being carried along by the operating means.

9 Claims, 24 Drawing Figures

$1_1$
12
$10_2$
1a
1b
$11_2$
$10_1$
13
$2_1$
$2_2$
$11_1$
3
$9_2$
$8_2$
$9_1$
$8_1$
4
$6_2$
$6_1$
$7_2$
$7_1$
5
16
17
A
$A_1$
$A_2$
15
B
$B_1$
$B_2$ 1b
11₂
13
3
9₂
8₁
4
A₁
6₁
7₂
B₁
B₂
5
17
16

10a
18
1
10b
10c
2
11a
11b
1
18
19
10c
2
20
12
12
11a
11b
11a
21

APPARATUS FOR THE MECHANICAL OPERATION OF THREAD OR YARN GUIDES

This invention relates to an apparatus for the mechanical operation of thread or yarn guides, such as hooks, shafts, and/or heddles or needles, or elements connected therewith, selectors at the one ends of the guides being adapted in response to external pulses to respectively permit and prevent shifting of the thread or yarn guides from given positions, and pairs of locking studs at the yarn or thread guides being adapted in response to the positions of the selectors to be respectively locked to, and left unactuated by, continuously reciprocating operating means which cause the shifting of said guides and are equipped with locking means.

In textile technics use has been made for many years of two different shedding principles, viz. the so-called double-lift fully open shed and the closed shed principles. Of these, the first-mentioned principle is the most advantageous for the following reasons. It requires half the number of revolutions per weaving cycle, it implies smaller acceleration and deceleration forces for the moving mechanisms, it provides a more quiet run, results in reduced wear of mechanical details, and permits a higher shedding or thread operating frequency.

These two shedding principles are utilized in two different kinds of shedding machines, viz. jacquard machines and dobbies.

Jacquard machines have hitherto been dependent upon gravity acceleration since the downward movement of the thread guides or the heedles is brought about by freely depending counterweights. This is highly disadvantageous in that the acceleration and the deceleration, respectively, cannot exceed the value 1 g.

This disadvantage is eliminated in a dobby where the heddles in each shaft are collectively and positively operated in both directions. Therefore, dobbies can work more rapidly than jacquard machines.

In machines where each shaft shall operate many warp threads of high thread tension and/or realize a very high change of shed frequency, the point load on the hooks and the dobby knives cooperating therewith, however, becomes considerable.

The said disadvantages of the two prior-art shedding principles are fully overcome by the present invention. According to the invention, the operating means are so arranged as to be capable, when the locking studs are engaged with them, of positively shifting the thread or yarn guides in both directions into as well as out of two extreme positions and also into and out of a center position; the thread or yarn guides in their respective positions determined by the selectors are under the action of spring means tending to move the guides away from the respective positions; the distances between, on the one hand, the locking studs and catches arranged at the guides and cooperating with the selectors, and, on the other hand, the dead centers of the operating means and portions of the selectors engaging said catches are so dimensioned that when the operating means reach their respective extreme positions, the thread or yarn guides are shifted a short distance against the action of the respective spring means so that a form-closed engagement between the locking studs and the selectors is cancelled, the yarn or thread guides being carried along by the operating means in the event that the position of the selector has been changed, while the locking engagement between the guide and the selector, should the selector remain in the earlier position, is only momentarily interrupted and the operating means returns without actuating the respective thread or yarn guides.

Among the further advantages gained by the present invention it should be mentioned that the apparatus is readily adjusted to various warp thread pitches, that is permits being rapidly rearranged to various passes or harness mountings, and that it is of a low overall height.

Embodiments of the apparatus according to the invention will be more fully described hereinbelow and with reference to the accompanying drawings in which:

FIGS. 1 to 8 diagrammatically show operating devices associated with a pair of thread or yarn guides, the component parts being shown in different positions;

FIGS. 9 and 10 show cross sections, on a larger scale, of the lower portion of a modified embodiment of a selector usable in the device shown in FIG. 1;

FIGS. 11 and 12 likewise in section and on a larger scale show the selector illustrated in FIGS. 9 and 10 in its entire extension; with the component parts shown in different positions in FIGS. 9 to 12;

FIG. 13 diagrammatically shows how a thread or yarn guide can be joined together with the aid of extension members so that one such guide can operate several guides, i.e. hooks, heddles or needles;

FIG. 14 diagrammatically shows a perspective view of how the joining illustrated in FIG. 13 can be provided;

FIG. 15 in side view and partly in section shows the design of a guide usable in conjunction with the device in FIG. 14;

FIG. 16 diagrammatically shows how spaced apart thread or yarn guides in a weaving machine can be actuated;

Figure 19:
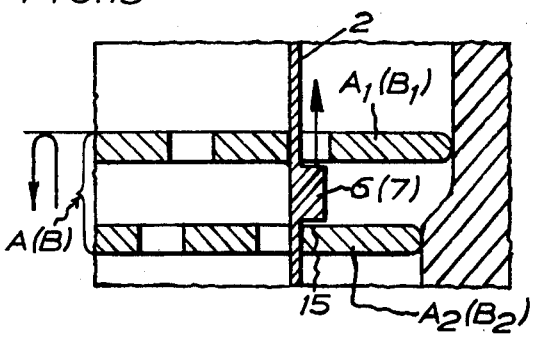
Figure 20:
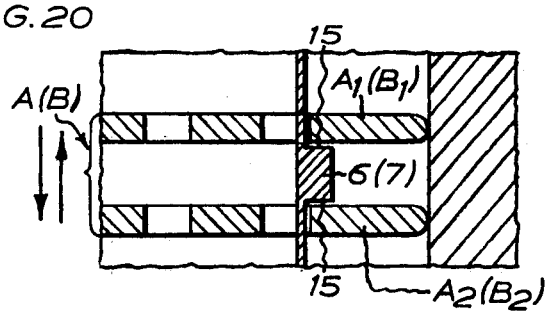
Figure 21:
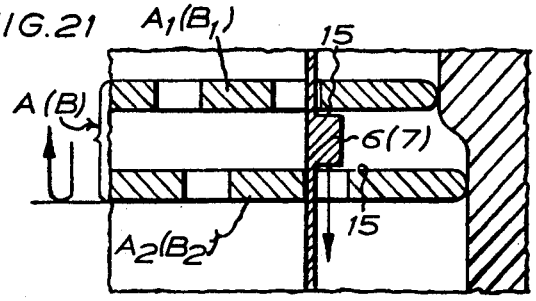
Figure 22:
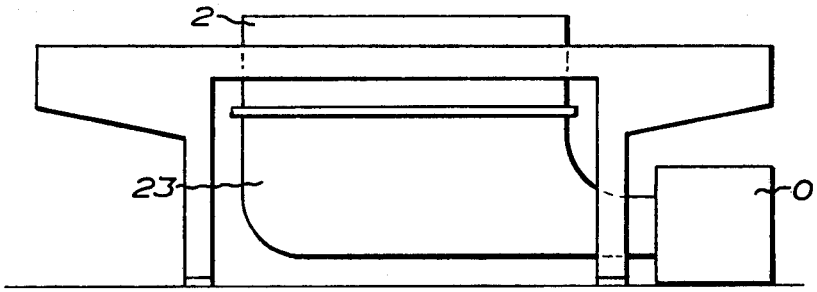
Figure 23:
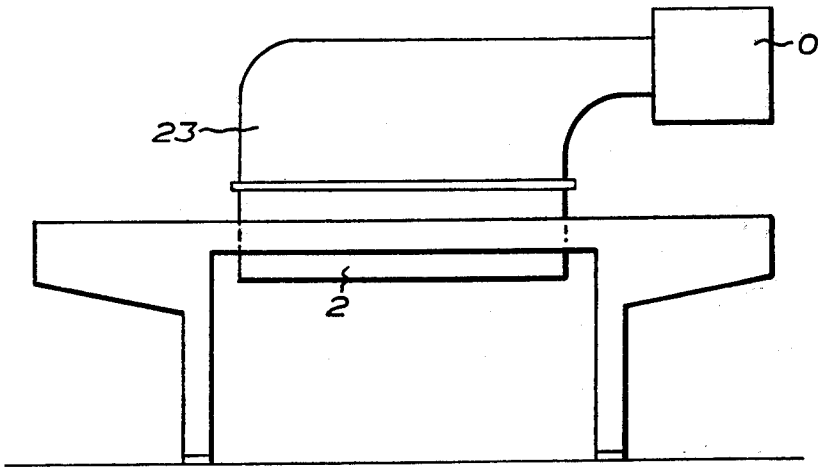
Figure 24:
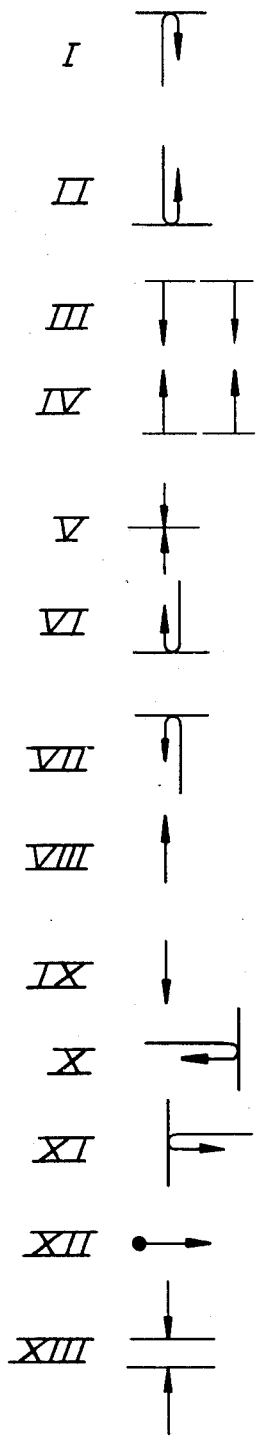

FIGS. 19, 20 and 21 partly in section show portions of the operating means of the apparatus in different positions of adjustment;

FIGS. 22 and 23 diagrammatically show two different possibilities of locating an apparatus according to the invention relative to a weaving machine;

FIG. 24 shows the symbols occurring in FIGS. 1 to 12, and 19 to 21; these symbols visualizing the movements of component parts in the apparatus.

The symbols in FIG. 24 have the following meanings:

I = thread or yarn guide at its upper dead center (upper shed)
II = thread or yarn guide at its lower dead center (lower shed)
III = thread or yarn guide on its way downwards
IV = thread or yarn guide on its way upwards
V = thread or yarn guide at standstill
VI = thread or yarn guide at its lower dead center
VII = thread or yarn guide at its upper dead center
VIII = operating means on its way upwards
IX = operating means on its way downwards
X = locking stud at its right-hand dead center
XI = locking stud at its left-hand dead center
XII = selecting pulse
XIII = limited vertical movement or play Component parts having the same or similar function have been marked with the same general reference numerals in the specification and in the drawings, and structural differences of such component parts have been indicated by various indices.

Two thread or yarn guides having mechanical operating devices are diagrammatically illustrated in FIGS. 1 to 8, and the various component parts are shown in the positions they occupy and in the combinations of movement and position, respectively, which arise during movement between the extreme positions, i.e. from upper shed to lower shed when the open shed system is utilized.

In the embodiment of FIGS. 1 to 8 use is made of selectors each of which consists of a substantially U-shaped yoke $1_1$ and $1_2$, respectively. Each yoke can swing between two positions against the action of a spring 12 by pulses supplied by a selector assembly (not shown). Each yoke has an arm 1*a* with a transversely cut, downwardly facing end, and an arm 1*b* likewise with a downwardly facing end 13 which presents a slanting guide surface inclined towards the first mentioned arm. A transverse hook-like abutment surface is arranged inside said guide surface and in its turn merges in a guide surface which slants in the same manner as the first-mentioned guide surface.

A pair of thread or yarn guides $2_1$ and $2_2$, can be hooks, heddles, needles or the like. As will appear from the foregoing, said guides, however, are preferably connected together with a plurality of hooks or the like and are movable through holes in fixed planes or bars 3, 4 and 5. The two upper bars 3 and 4 are designated return bars while the lower bar 5 is designated supporting bar.

Locking studs $6_1$, $7_1$ and $6_2$, $7_2$, respectively, are fixed to each guide $2_1$, $2_2$ and, as will be described in the following, the locking studs are adapted for actuation by the operating means A and B.

Pairs of springs $8_1$, $9_1$ and $8_2$, $9_2$, respectively, are disposed on each guide between the fixed planes or the return bars 2 and 3, more precisely on either side of abutments fixed to said guide. Said springs can engage the planes 3 and 4.

Catches are disposed at the upper end of the guides. Each catch is in the form of a head $10_1$ and $10_2$, respectively, which has a planar upper side and an obliquely outwardly and upwardly inclined guide surface. A short distance beneath the head 10 each guide has a further catch $11_1$ and $11_2$, respectively, which has a downwardly facing planar abutment surface and an obliquely downwardly and outwardly facing guide surface.

Figure 17:
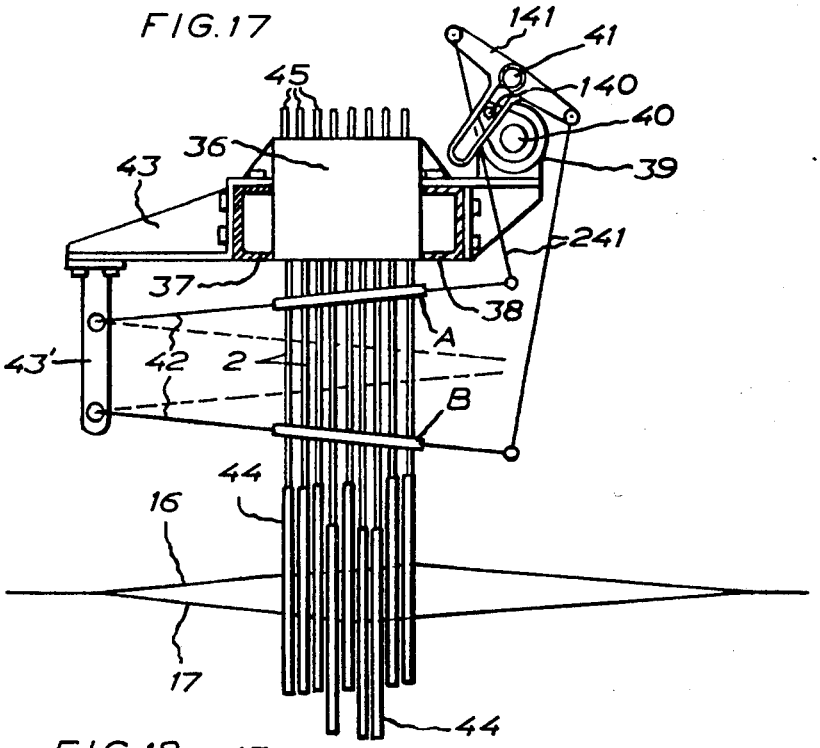
FIG. 17 shows a side view of a dobby equipped with the apparatus according to the invention.
Figure 18:
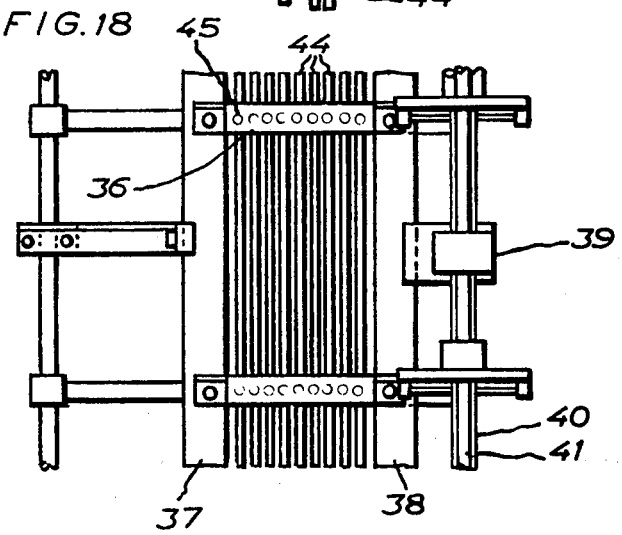
FIG. 18 shows a top plan view of the dobby in FIG. 17.

Each operating means A and B, respectively, includes locking plates $A_1$, $B_1$ and $A_2$, $B_2$, respectively, which are reciprocally adjustable in the transverse direction by means of curved bars or the like and which are vertically movable by means of a mechanism shown in FIGS. 17 and 18. Holes are formed in each of the locking plates, and the edges 15 of said holes serve as abutment surfaces for the locking studs 6 and 7 of the guides 2. Each operating means is adapted to actuate a plurality of guides.

The aforementioned springs 8 and 9 have the task of returning the guides from their extreme positions, i.e. from the upper shed and lower shed position, respectively. The springs are kept slightly compressed against their respective return bars when the guides turn against the respective return bar.

In the event that the guide means are connected with shafts joined to many heddles the tension in the warp 16 and 17 can be exploited as a return spring force. At least one of the return springs can thus be dispensed with.

The selectors can occupy two different positions. When a guide pulse is supplied the selectors 1 swing against the action of the spring 12 to the right in the drawing, the arm 1*a* preventing the guide 2 associated with the selector from being moved upwardly. In the absence of a guide pulse the selector is kept in its left-hand position by the spring 12, the guide being allowed to move upwardly, whereas a downward movement thereof is prevented by the engagement between the abutment surface of the hook 13 and the catch 11 of said guide.

Figures 1, 2, 3, 4:
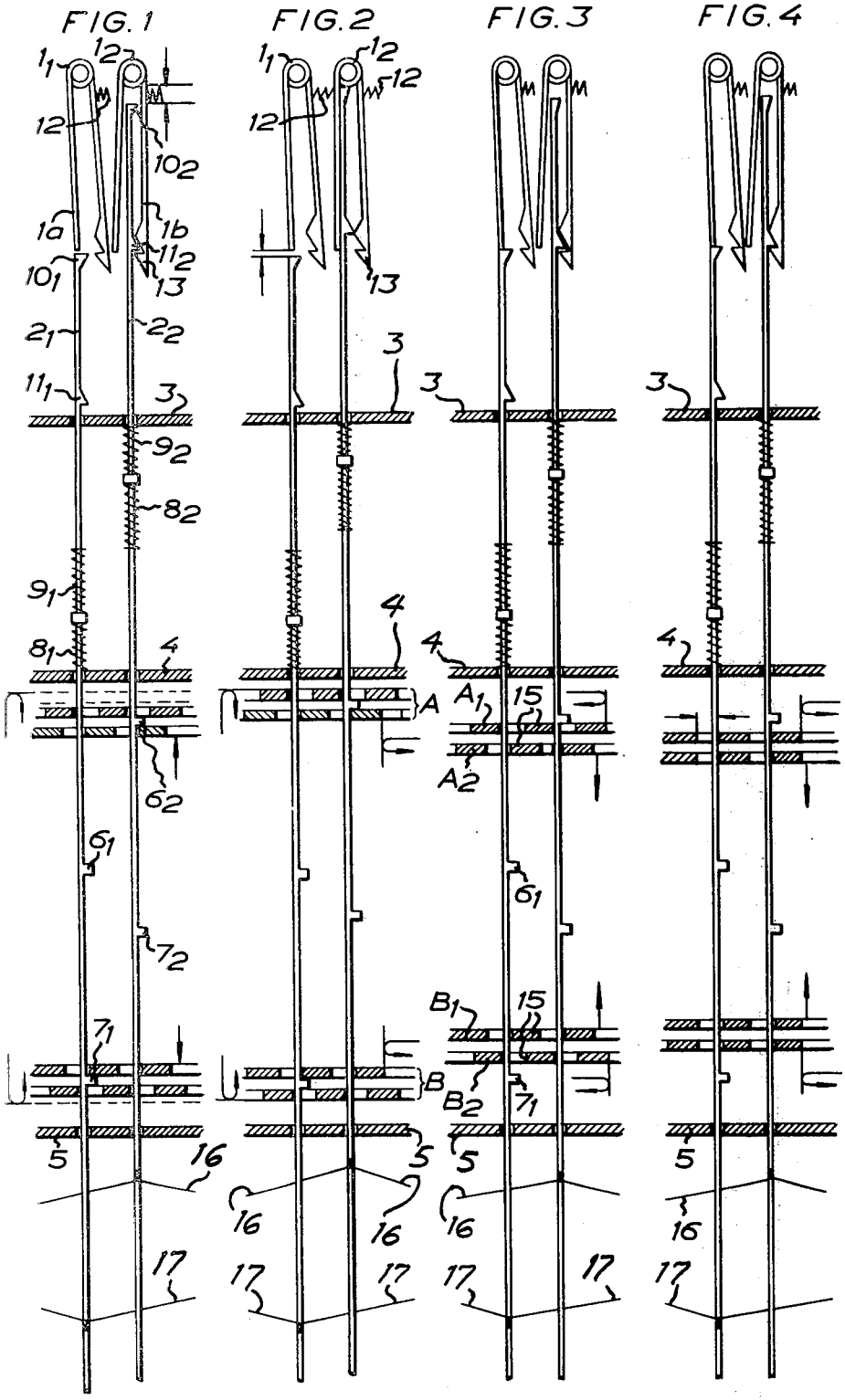

The function of the apparatus shown in FIGS. 1 to 8 will now be described more in detail. In FIG. 1 the operating means A and B approach their upper and lower dead centers, respectively. In the preceding weaving cycle the selector $1_1$ occupied the latching position for the upward movement of the guide $2_1$. A new pattern pulse is already actuating the selector $1_1$, for which reason the arm 1*a* is in latching engagement with the head $10_1$. The lowermost catch $7_1$ of the guide means $2_1$ is urged downwardly by the locking plate $B_1$ of the operating means B when the latter approaches its lower dead center. The return spring $8_1$ is already being compressed against the return plate 4. The guide $2_2$ is urged upwardly towards its upper dead center by the upper operating means A, the return spring 9 being compressed against the return plate 3. The arm 1*b* of the selector $1_2$ is moved to the right in the drawing by the engagement between the slanting guide surfaces of said bar and the catch $11_2$ during the remainder of the movement towards the upper dead center.

In FIG. 2 the pattern pulse still actuates the selector 1 so that is remains in its left position. The guide $2_1$ now is at its lower dead center under the action of the operating means B. A play is shown between the arm 1*a* and the head of the guide $2_1$.

The guide $2_2$ is at its upper dead center and the slanting guide surface of the catch $11_2$ has urged the right-hand arm 1*b* of the selector $1_2$ outwardly. No pulse actuates the selector $1_2$, for which reason the arm 1*b* by the action of the spring 12 returns to its left position when the guide turns back downwardly because of the cooperation between the spring $9_2$, the catch $6_2$ of the guide $2_2$ and the locking plate $A_2$ of the operating means A. If, however, a pattern pulse had actuated the selector the arm 1*b* thereof would have remained in its right position.

In FIG. 3 the operating means A and B are on their way downward and upward, respectively. The locking plate $B_1$ has left the locking stud $7_1$ of the guide $2_1$, but the return spring $8_1$ now urges the guide $2_1$ upwardly from the return plate 4 against the arm 1*a* of the selector and retains it in said position, i.e. in the lower shed, until a new selecting cycle begins immediately ahead of the position shown in FIG. 6.

The operating means A with its locking plate $A_2$ has left the locking stud $6_2$ of the guide $2_2$. By its engagement with the return plate 3 the return spring $9_2$ keeps the catch $11_2$ of the guide $2_2$ in fixed engagement with the hook-shaped abutment surface 13 of the arm 1*b* of the selector $1_2$. The guide $2_2$ is now retained in the upper shed position while the operating means A and B move to their lower and upper dead centers, respectively.

When the operating means A and B have reached their positions shown in FIG. 3 the locking plate $A_1$ begins to move to the left from its right dead center. The locking plate $B_2$ at the same time moves from its right dead center towards its left dead center.

The said movements have been completed in FIG. 4. All locking plates are at their left dead centers. If the guides $2_1$ and $2_2$ had not been latched, the return springs $8_1$ and $9_2$ would have respectively raised and lowered the guides $2_1$ and $2_2$ so that said guides with their locking studs $7_1$ and $6_2$ had been given the same respective movements upward and downward as the operating means A and B from the respective lower and upper dead center in FIG. 2.

Figures 5, 6, 7, 8:
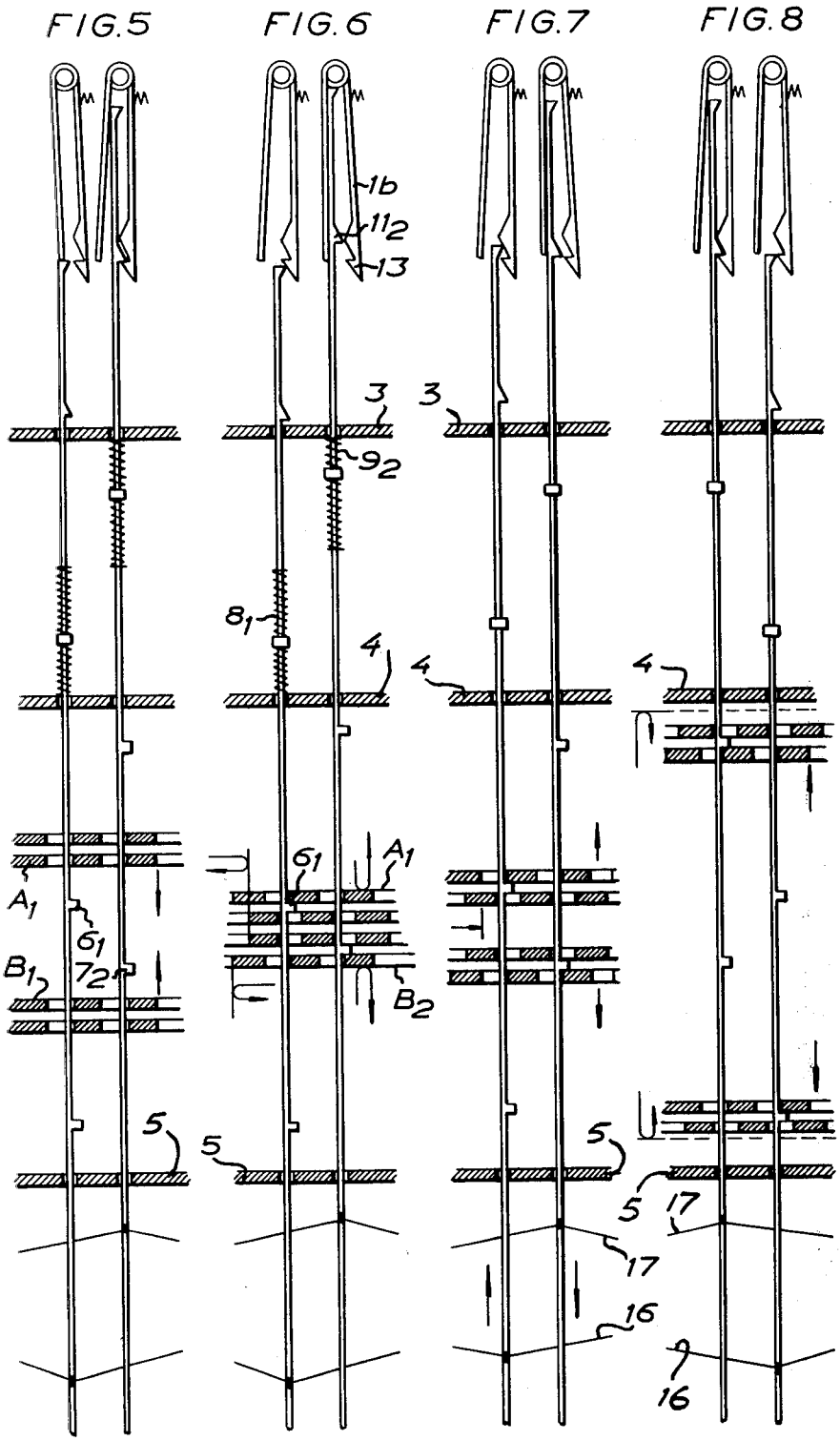

The locking studs $7_1$ and $6_2$ had then been applied against the locking plate $B_1$ and the locking plate $A_2$, respectively, during their movements up to a position corresponding to that shown in FIG. 5. In the position shown in FIG. 4 the locking plates $A_1$ and $B_2$ have been moved to the left. The locking studs $7_1$ and $6_2$ would then have been locked between the locking bars $B_1$ and $B_2$ and $A_1$ and $A_2$, respectively, in the operating means B and A, respectively, and been pulled by said means to the opposite dead centers. Thus, the guide means $2_1$ would have been positively moved from the lower shed to the upper shed while the guide $2_2$ would have been moved from the upper shed to the lower shed.

Between the positions shown in FIG. 5 and FIG. 6 the locking plates $A_2$ and $B_1$ in the operating means A and B, respectively, are moved to the right so that the locking studs $6_1$ and $7_2$ as well as the locking studs $7_1$ and $6_2$ of the guides $2_1$ and $2_2$ can pass in between the hole edges 15 of said plates.

In FIG. 6 the operating means A and B are closest to each other, that is at the lower and the upper dead center, respectively. During the shedding phases shown in FIGS. 5, 4 and 3 the guides $2_1$ and $2_2$ have been at standstill in their upper shed and lower shed positions, respectively. In FIG. 6 the locking bar $A_1$ has caught up with, and pulled the locking stud $6_1$ of the guide $2_1$ downwardly, whereby the return spring $8_1$ has been tensioned at the same time as the arm 1*a* of the selector $1_1$ has been released. The spring 12 has moved the selector to the left since no pattern pulse actuates the selector.

The guide $2_2$ is in its uppermost position and the catch $11_2$ has urged the right arm 1*b* of the selector $1_2$ outwardly. A short time before, a pattern pulse has actuated the selector so that it remains in said position. The return spring $9_2$ keeps the guide $2_2$ pressed against the locking plate $B_2$ which now begins to travel vertically downward. Because of the pressure of the spring $9_2$ against the return plate 3 the guide $2_2$ is carried along in the downward movement of the operating means. The catch $11_2$ can now go past the hook at 13 on the right arm 1*b* of the selector $1_2$.

In the position shown in FIG. 7 the catch $11_2$ goes past the hook-shaped engagement surface at 13. Because of remaining tension in the return springs $8_1$ and $9_2$ the guides $2_1$ and $2_2$ are now carried along by the operating means A and B in the movements to the upper shed and lower shed, respectively. When the operating means A and B are on their way upward and downward, respectively, between the positions shown in FIG. 7 and FIG. 5 and while the spring tension of the springs $8_1$ and $9_2$ is still in effect, the locking bars or plates $A_2$ and $B_1$ are moved back to their right dead centers. All locking plates $A_1$, $A_2$, $B_1$, $B_2$ now occupy the position shown in FIG. 5.

Until the upper positions according to FIG. 4 are reached the locking studs $6_1$ and $7_2$ are arrested between the locking plates $A_1$, $A_2$ and $B_1$, $B_2$, respectively. When the operating means are on the same level as in their position according to FIG. 3 the locking plates $A_1$ and $B_2$ have been moved back to their right dead centers.

In the position shown in FIG. 8 the left-hand thread or yarn guide has occupied the same height position, i.e. the upper shed position, as that occupied by the guide $2_2$ in FIG. 1, while the right guide in the first mentioned position has arrived in the same position as the guide $2_1$ in FIG. 1. Thus, the guides and the warp threads 16 and 17 have been moved from the upper shed to the lower shed, and vice versa.

For half a cycle, i.e. the movements from FIG. 2 to FIG. 6 inclusive the warp threads 16 and 17 have remained in open shed; during the remaining movements change of shed has taken place.

FIG. 8 shows that a pattern pulse actuates the arm 1*a* of the selector. This means that, when the guide $2_1$ moves upward to its upper dead center, the arm 1*b* will be urged outward to the right and be retained in this position by the pressure pulse. The guide $2_1$ will thus not be hooked up but will accompany the operating means A downward into the lower shed position. The guide $2_2$, on the other hand, will be moved upward to the upper shed since no pattern pulse occurs.

In the modified embodiment of the selector shown in FIGS. 9–12 a thread or yarn guide is designated $2_1$ as in the earlier embodiment. Catches 10*a*, 10*b*, 10*c*, 11*a* and 11*b* are provided in this modified embodiment. In structural respect, the catches differ from those illustrated in FIGS. 1 to 8 in that each of them has two parallel guide and engagement surfaces, respectively, which are oblique to the longitudinal and transverse direction of the guides. In the catches 10*a*, 10*b* and 10*c* the inclination of the surfaces is opposed to that of the catches 11*a* and 11*b*.

The selector device includes a laterally open sleeve-like member 20 in which runs the upper end of the guide $2_1$, and a selector 1 which is loosely mounted at the upper end so as to permit being swung between two positions. A leaf spring actuates the selector and tends to keep it close to the guide 2. The selector 1 is of light weight and adapted to be shifted against the action of the spring 12 by compressed air which is brought to act against the side of the selector facing the guide 2. At the lower end of the selector there is formed a latching recess which is constituted by two abutment surfaces which are parallel with those of the catches 11*a* and 11*b*. The lower end of the selector has a similarly located guide surface. A further recess having two surfaces parallel with the engagement surfaces of the catches 10*a*, 10*b* and 10*c* lies beyond the first mentioned recess and is separated from it by an intervening projection 19. A projection 18 having an upper guide surface parallel with the upper abutment surface of the upper recess is arranged above said recess.

Figures 9, 10, 11, 12:
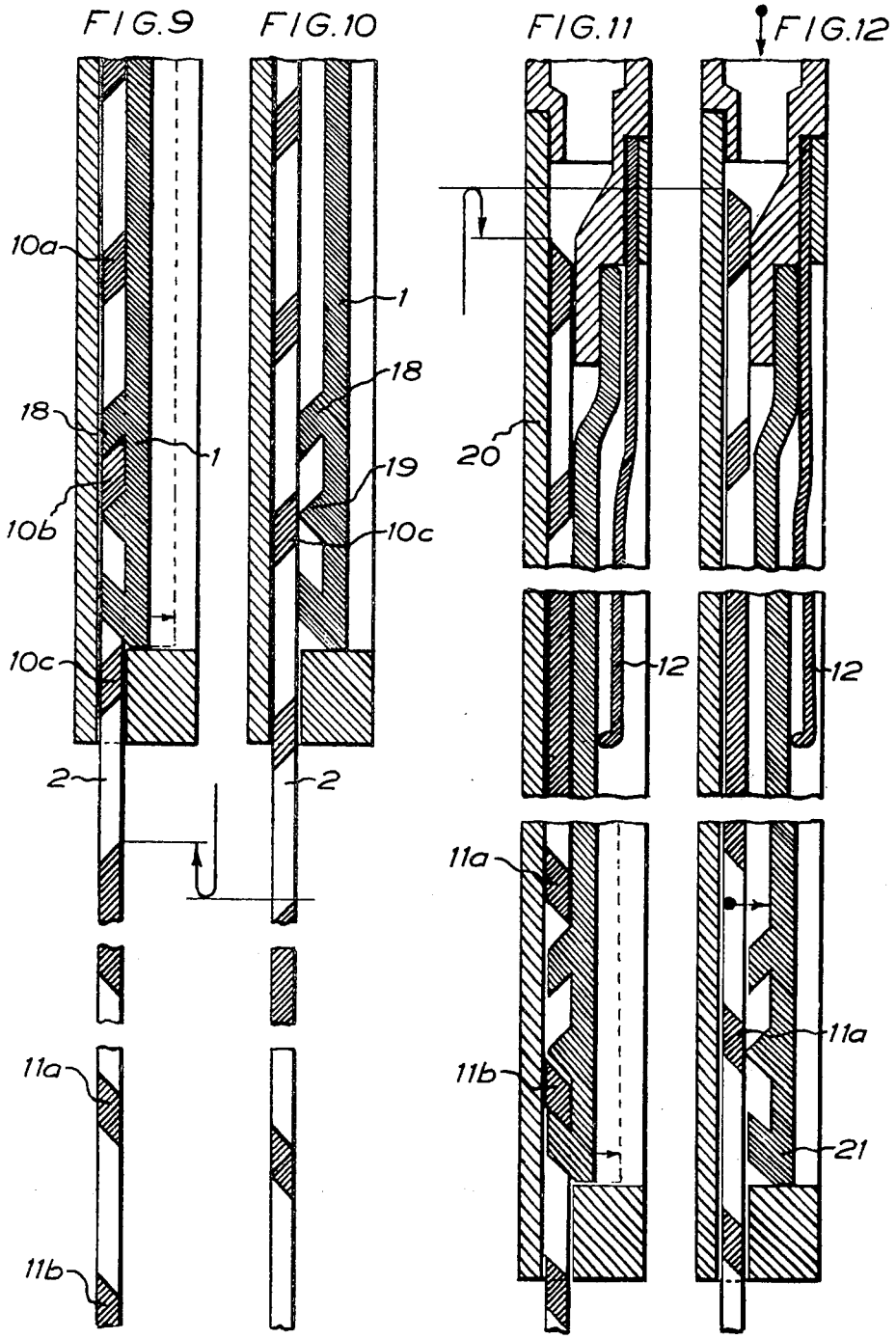

FIG. 9 shows the thread or yarn guide 2 in the lower shed position. The guide is blocked against upward movement in that the catch 10*b* is engaged in the recess beneath the projection 18. FIG. 10 shows the guide 2 at the lower dead center. The catches 10*a*, 10*b* and 10*c* do not at their downward movement engage in any of the latching recesses of the selector 1 as said selector 1 is swung aside as a result of the latching means engaging the guide surfaces. Thus, in the position shown in FIG. 10 the catch 10*c* by its engagement with the projections 18 and 19 has urged the selector 1 to the right against the action of the leaf spring 12. In the presence of a pattern pulse, i.e. if compressed air actuates the selector, said selector will remain in the position shown in FIG. 10, the guide 2 being also capable of moving upward and going past the catch of the selector. The guide can thus be moved upward as long as the compressed air actuates the selector. When the guide has reached its upper dead center, i.e. the upper shed position, in FIG. 12 and is on its way downward, one of the lower catches 11*a*, 11*b* of the guide can engage the lower recess of the selector 1, i.e. the recess in the projection 21, provided no pattern pulse actuates the selector so that it is moved to the left.

The embodiment illustrated in FIGS. 9 to 12 can also produce a so-called pure shed. As will appear from FIGS. 9 and 10 as well as from FIGS. 11 and 12 the catches 10*a*, 10*b* and 10*c* are of a configuration and inclination other than the catches 11*a*, 11*b* and 11*c*. This configuration has been chosen to allow the catches to cooperate with the recesses in the projections 18 and 21 of the selector. It should be mentioned that the projections 18 and 21 have the same function as the arms 1*a* and 1*b* of the selector shown in FIGS. 1 to 8.

Figure 13:
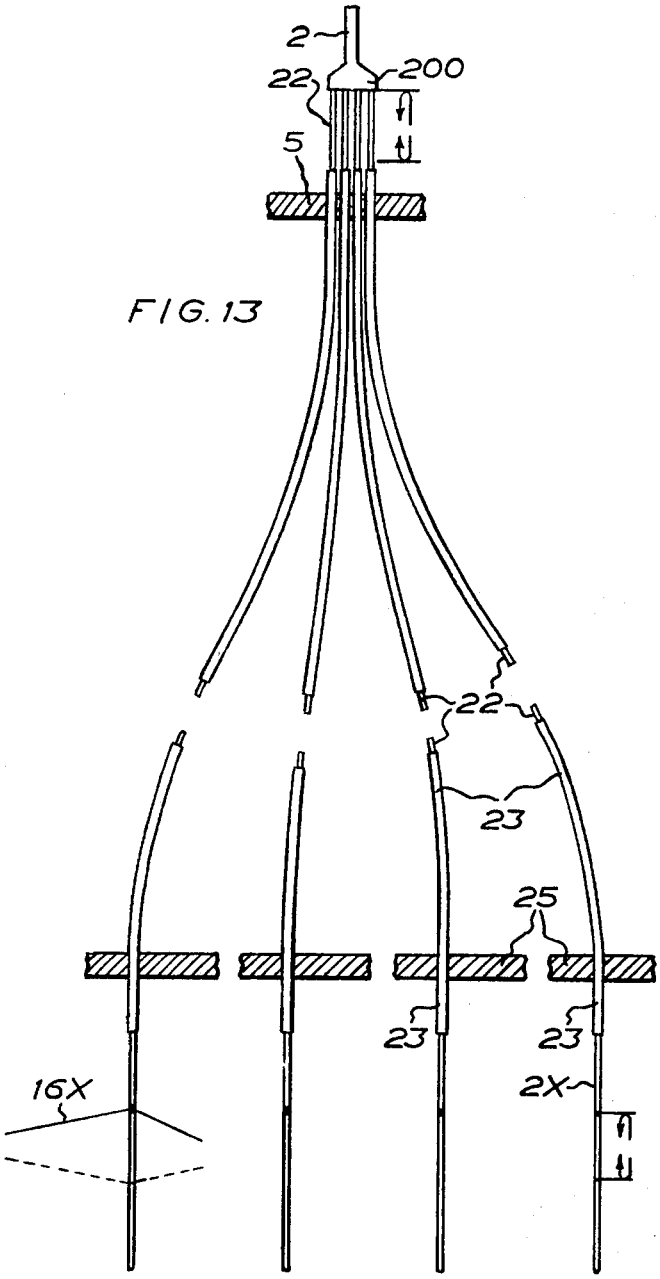
Figure 14:
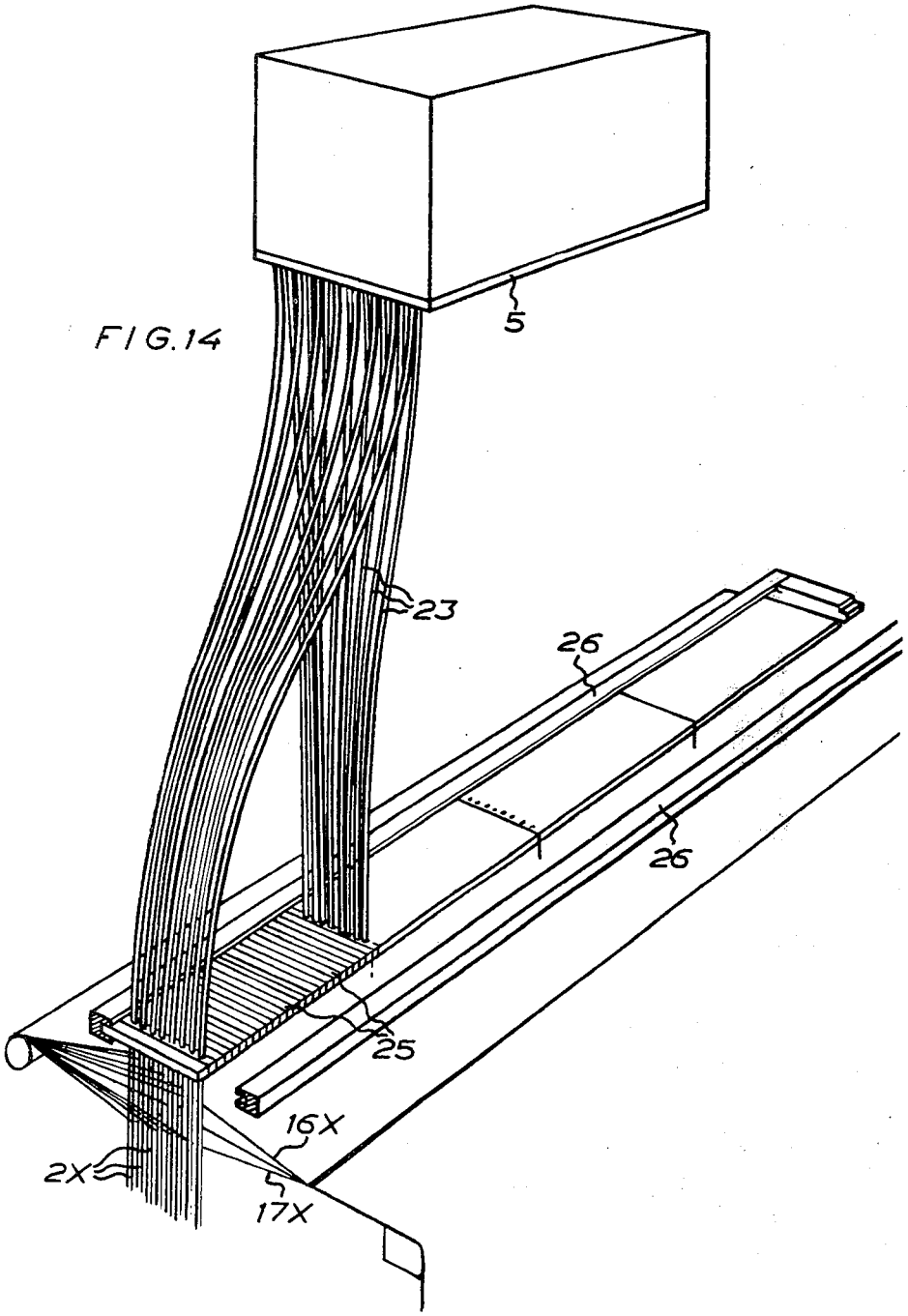

FIGS. 13 and 14 illustrate how thread or yarn guides 2 actuated by selectors and operating means of the type already described can be connected with a plurality of hooks, heddles or like means 2X which actuate warp threads or the like 16X and 17X. In the Example shown in FIG. 13 four flexible cords or the like 22 are fixed to a head 200 disposed at the lower end of the guide 2. The cords 22 run in guide sleeves 23 from a plate corresponding to the lowermost plate 5 in the apparatus according to FIGS. 1 to 8, to a common guide plane 25 formed by a plurality of transverse strips 24 in which mating recesses are provided, said guide plane being disposed between bars 26. The guide plane 25 is variable within broad limits by rearrangement or exchange of the strips 24.

Figure 15:
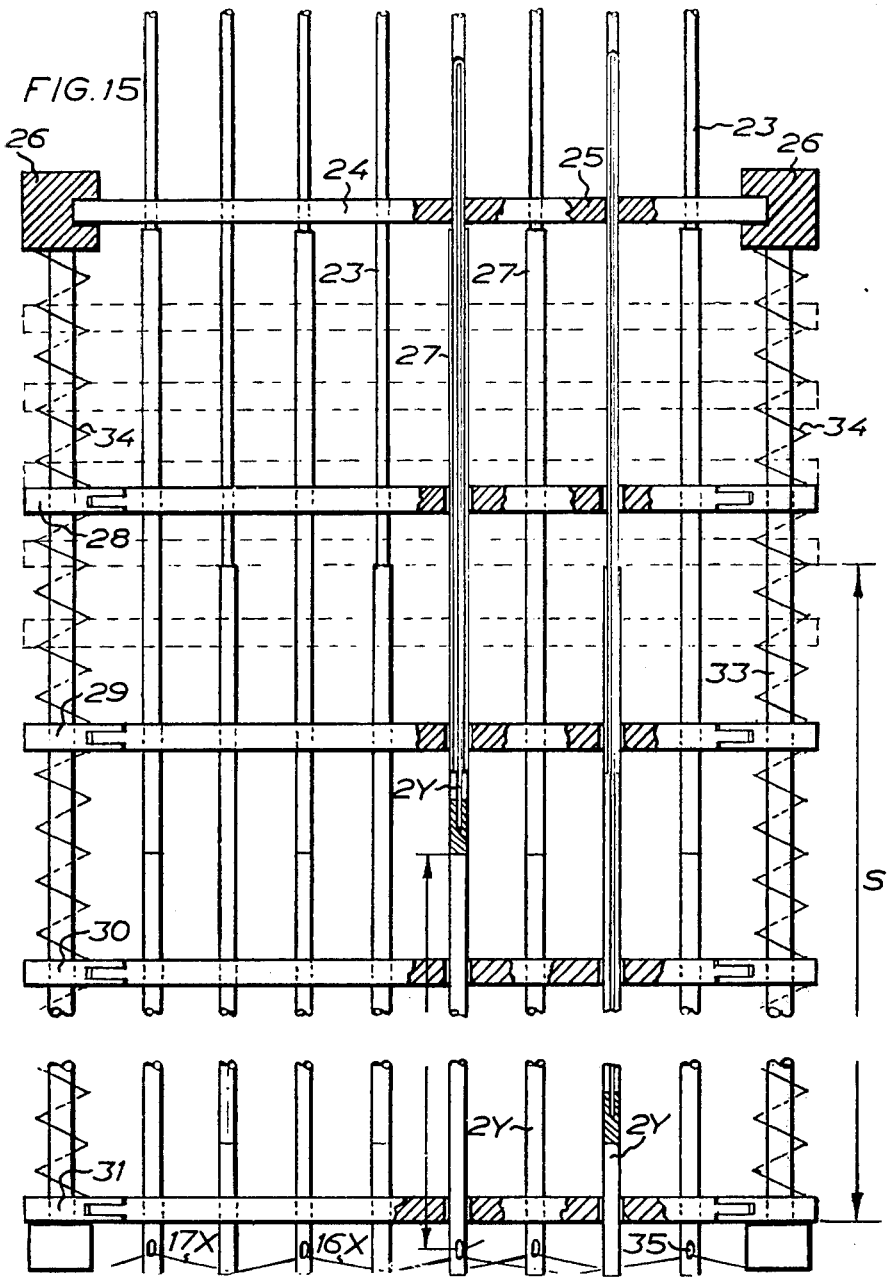

FIG. 15 shows how flexible heddles 2Y are connected to the flexible cords and the guide sleeves 23. A movable sleeve 27 is passed onto each of the guides 2, more particularly the end thereof which extends downward through the guide plane 25, and the end of the heddle connected to the cord 22 running in the guide 23 is fixed to the lower end of said movable sleeve 27. The sleeves 27 and the heddles 2Y are guided by a number of supporting plates 28, 29, 30 and 31 which in turn are passed with intervening springs 34 onto fixed guide pins 33. In normal operation the plates 26, 28, 29, 30 and 31 are kept spaced apart by the springs 34. Whenever it is necessary to get at a heddle, for instance when a warp thread has ruptured, the plates 28–31 can be compressed in an upward direction, whereafter the heddle in question can readily be bent aside, permitting the requisite measures to be taken.

Figure 16:
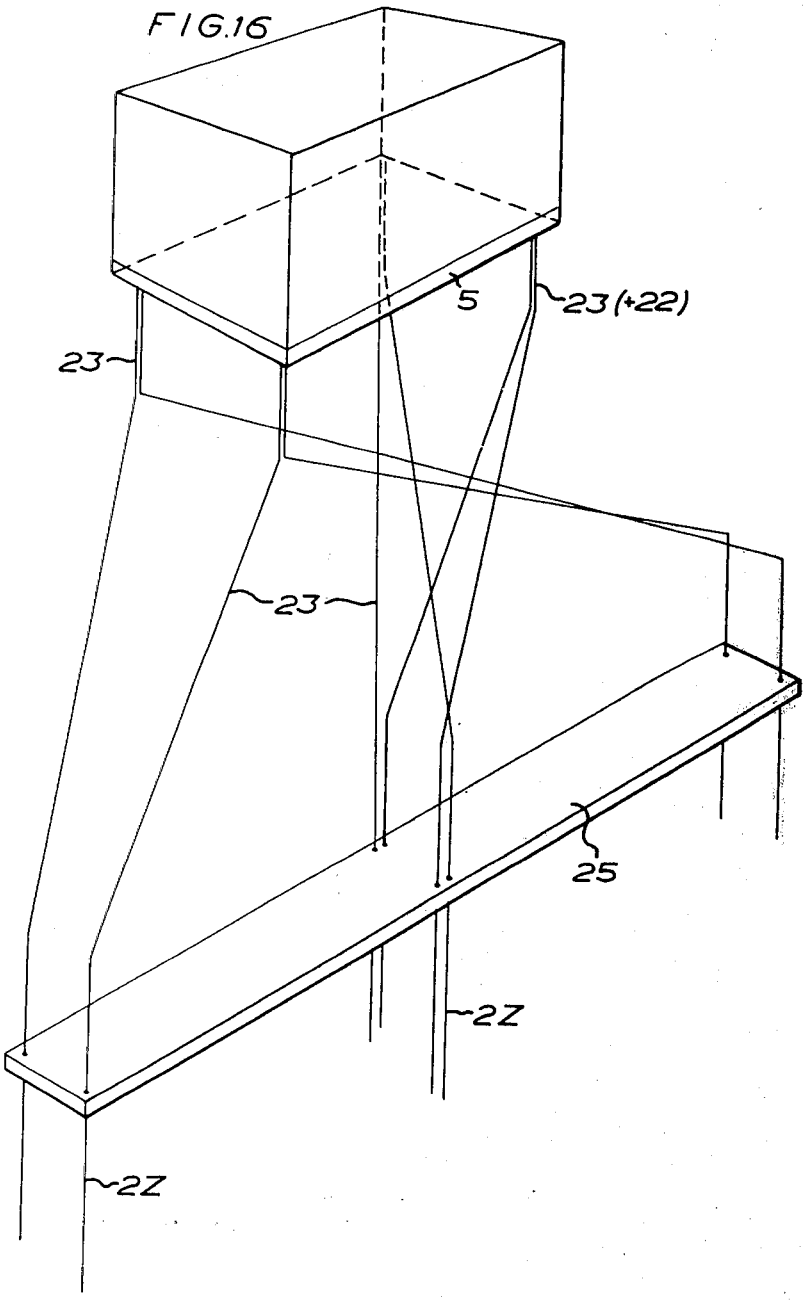

FIG. 16 diagrammatically shows how it is possible, from an operating means of the kind earlier described and in an optional manner, to pull the guides 23 with the cords 22 from the plate 5 to the guide plane and from there to the heddle 2Z in dependence on the desired pattern or pass. By shifting heddles or groups of heddles with associated guides through 180° it is possible to provide so-called return or point pass and by other rearrangement it is possible to obtain other pass combinations, such as mixed passes, grouped passes etc. The construction of the apparatus also permits an easy exchange and connection of prepared cord and guide units which produce desired passes.

The apparatus according to the invention can be used in a dobby and FIGS. 17 and 18 illustrate an example of the mechanical construction of such a dobby.

In FIG. 17, 36 designates a unit which comprises selectors similar to those shown in FIGS. 1 to 8 or 9 to 12. The thread guides are designated 2 and the operating means A and B, as before. The warp threads to be guided carry the designations 16 and 17.

Above, or alternatively beneath, the warp two supporting beams 37 and 38 are mounted to a machine frame. Bearings 39 for a driven rotary shaft 40 are provided at mutual spacings on the beam 38. Bearings for a further shaft 41 are mounted to the beam 38, and said shaft which is transversely movable carries a number of rockers 141. The rockers are rockable alternately in one and the other sense by means of crank or curve mechanisms 140 provided on said shaft 40. Links 241 are connected to each of said rockers and are in turn coupled to levers 42 carrying the operating means A and B. The levers 142 are pivoted to holders 43' which in the warp direction are movably fastened to brackets 43 mounted to the beam 37. The guides 2 are connected to the shafts 44 through which the warp threads 16 and 17 are run.

Even though the selector unit 36 can include return plates and return springs similar to those described in connection with FIGS. 1 to 8, it is readily seen that the return springs can be dispensed with in the machine here illustrated. In fact, the warp thread tension in the upper shed and the lower shed, respectively, usually is a sufficient return force.

The selector unit 36 can be supplied with pulses mechanically, pneumatically, hydraulically or electromagnetically. Reference numeral 45 in FIGS. 17 and 18 indicates pulse transmitting means.

The hooks are here connected in sequence to the shafts 44 and the apparatus produces a so-called pure shed.

It will be apparent from FIG. 17 that the operating means A and B occupy slanting positions so that all warp threads in the upper shed and the lower shed 16 and 17, respectively, will lie on the same level. The guides 2 must therefore occupy different heights in the selecting positions. For this reason, like in the examples according to FIGS. 9 to 12, the guides 2 have been provided with a plurality of catches and of these catches those of suitable position will enter into engagement with the hook-like abutment surfaces of the selectors. The selector device can thus latch or arrest the guides on different levels.

The function of the operating means A and B incorporated in the earlier described embodiments is elucidated in FIGS. 19, 20 and 21. Each of the means A or B which can be supported for instance by levers pivoting up and down such as in FIG. 17, comprises two laterally movable operating plates $A_1$ and $B_1$, respectively. At least on one side the ends of the planes run along a curved path designated C. In dependence on the configuration of the curved path none of the plates, both plates, one plate or the other plate, is shifted laterally.

In FIG. 19 the upper plate $A_1$ is unactuated whereas the lower plate $A_2$ is shifted. This means that the locking studs 6 or 7 and the guide 2 has been carried along by the engagement between the locking stud and the edge of the hole 15 in the plate $A_2$ to the upper dead center illustrated, but that the corresponding edge of the hole in the plate $A_1$ goes past the locking stud without actuating it and thus without actuating the guide 2, when the operating means turns and moves downward.

Both operating plates $A_1$ and $A_2$ are shifted in FIG. 20, the guide means 2 being carried along in both upward and downward movements.

In the position shown in FIG. 21 the situation is opposite to that shown in FIG. 19, and the guide 2 is thus carried along to the lower dead center, but is not carried along in the upward movement of the operating means.

The function of the operating means B corresponds to what has been described for operating means A.

FIGS. 22 and 23 diagrammatically illustrate how the mechanical operating mechanism according to the invention can be mounted in jacquard machines. In FIG. 22 the apparatus generally designated 0 has been placed obliquely beneath the jacquard machine proper and the guide 23 for the cords actuating the heddles have been pulled laterally and up to the weaving machine. With the use of the apparatus according to the invention one is not any more bound to the hitherto customary location of the selecting, operating and guide means, and the jacquard machine can therefore be made considerably less bulky.

The embodiment shown in FIG. 23 is slightly reminiscent of the conventional embodiment nowadays applied, but it brings the advantage that the apparatus 0 can be placed for operating purposes in a more readily accessible and appropriate manner and be connected with the loom by flexible guides 23.

While the invention has been described in several preferred embodiments with reference to the specification and drawings it is readily seen that it can be modified in several ways within the spirit and scope of the appended claims.

What I claim and desire to secure by Letters Patent is:

1. An apparatus for the mechanical operation of yarn guides comprising, selectors mounted at one end of the yarn guides, said selectors being operable in response to external pulses to respectively permit and prevent shifting of the said yarn guides from given positions, a pair of locking studs on each of said yarn guides, operating means continuously reciprocating between extreme dead center positions for shifting said yarn guides, said operating means including means for engaging said locking studs for positively shifting said yarn guides in both directions into and out of two extreme positions and a central position, spring means tending to move said yarn guides from said extreme positions, cooperating catch means on said yarn guides and on said selectors for releasably retaining said yarn guides in said extreme positions, said locking studs being adapted in response to the position of the associated selector to be respectively locked to and left unlocked from said operating means, the distance between said catch means on said yarn guides and said locking studs and the distance between said dead center positions of said operating means and said catch means on said selectors being such that as said operating means reaches said dead center positions, said yarn guides are moved a short distance against the action of said spring means whereby a form-closed engagement between said studs and selectors is canceled, said yarn guides being carried along by said operating means in the event that the position of the selector has been changed by an external pulse, while the locking engagement between the yarn guide and selector is only momentarily interrupted and the operating means returns without actuating the respective yarn guides when the selector position remains unchanged.

2. An apparatus as claimed in claim 1, wherein the yarn guides in turn are further provided with guide means movable in both directions with the aid of the operating means.

3. An apparatus as claimed in claim 1, wherein the yarn guides are connectable both individually and groupwise with a number of elements such as hooks, shafts, and heddles or needles.

4. An apparatus as claimed in claim 3, wherein said elements connectable with said yarn guides are provided with flexible extensions running in flexible guide means and connecting the respective element with the yarn guide actuated by the operating means.

5. An apparatus as claimed in claim 4, wherein said flexible guide means and said elements are relatively shiftable in order to permit changing their relative positions.

6. An apparatus as claimed in claim 1, wherein said operating means comprises bars movable by rockers in both directions and through which the yarn guides pass, said bars each comprising pairs of adjacent profile members engaging and relatively shiftable by fixed cam members, said profile members of said bars being formed with openings which in one position of shift permit the bars to be moved along said yarn guides without engaging with said locking studs of said yarn guides, in another position produce engagement upon movement in both directions, in a third position produce engagement with said locking studs upon movement in one direction only and in a fourth position produce engagement with said locking studs upon movement in the opposite direction.

7. An apparatus as claimed in claim 2 further comprising relatively shiftable lateral support means having openings therein, said yarn guides passing through said openings.

8. An apparatus as claimed in claim 7, wherein said lateral support means comprises loose strips formed with recesses, and wherein rows of such strips separated by preferable resilient spacers are provided on different levels along said guide means.

9. An apparatus as claimed in claim 7 wherein the guide means and the lateral support means arranged at said yarn guides are reversible whereby it is possible, for instance in weaving machines, to modify the pattern produced.

* * * * *